US005077903A

United States Patent [19]

Kreim

[11] Patent Number: 5,077,903

[45] Date of Patent: Jan. 7, 1992

[54] CARPENTER'S PENCIL SHARPENER

[76] Inventor: Erich P. Kreim, Box 220, Fonda, N.Y. 12068

[21] Appl. No.: 627,774

[22] Filed: Dec. 14, 1990

[51] Int. Cl.[5] ..... B43L 23/00; B43L 23/02; B43L 23/06

[52] U.S. Cl. ..... 30/451; 30/453; 144/28.1

[58] Field of Search ..... 30/451, 452, 453, 455, 30/456, 457, 458, 459, 460; 144/28.1, 28.2, 28.3, 28.4, 28.5, 28.6, 28.7, 28.8, 28.9, 28.10, 28.11, 28.7, 28.72, 28.74

[56] References Cited

U.S. PATENT DOCUMENTS

| | | | |
|---|---|---|---|
| 673,770 | 5/1901 | Fortunati . | |
| 1,160,091 | 11/1915 | Stewart . | |
| 1,202,325 | 10/1916 | Simmons | 144/28.1 |
| 1,333,740 | 3/1920 | Steinman . | |
| 2,853,053 | 9/1958 | Hamilton . | |
| 3,965,949 | 6/1976 | Aston et al. . | |
| 3,980,113 | 9/1976 | Birdshall | 144/28.6 |
| 4,402,354 | 9/1983 | Halpern | 30/454 |
| 4,759,129 | 7/1988 | Alpha . | |
| 4,918,816 | 4/1990 | Alpha | 30/453 |
| 4,961,451 | 10/1990 | Bucci | 144/28.1 |

*Primary Examiner*—Douglas D. Watts
*Assistant Examiner*—Paul M. Heyrana, Sr.
*Attorney, Agent, or Firm*—J. Michael McClanahan

[57] ABSTRACT

A carpenter's pencil sharpener for use in sharpening rectangularly shaped carpenter's pencils is disclosed wherein at the top of the housing the pencil sharpener is situated two rectangularly shaped openings juxtaposed to each other, the first a longitudinal opening and the second a transverse opening. Immediately below each of the pencil openings are a pair of oppositely driven rotary cutter assemblies. Each rotary cutter assembly is stepped, having a large diameter cylindrical cutting head mounted upon a shaft with a small diameter cylindrical cutting head juxtaposed to it, both on the same shaft. The two large diameter cutting heads receive the long side of the carpenter's pencil through the longitudinal opening to fashion an elongated point upon the pencil. The two small diameter cylindrical cutting heads receive the short sides of the carpenter's pencil through the transverse opening to chamfer the short sides. By interconnecting gears, an electrical motor rotates the rotary cutter assemblies.

11 Claims, 1 Drawing Sheet

CARPENTER'S PENCIL SHARPENER

BACKGROUND OF THE INVENTION

1. Field of the Invention

The field of the invention is pencil sharpeners and more particularly, those adapted to sharpen the rectangularly shaped carpenter's pencil.

2. Description of the Related Art

The commonly known carpenter's pencil is widely used by carpenters and has also found wide use among persons other than carpenters. For example, the pencil is becoming widely used by art students and other parties who wish to make very wide lines or wide shadings when making pencil drawings. The carpenter's pencil is characterized as being rectangular in cross-sectional shape, it being constructed of wood covering a graphite core, the core having a rectangular shape in the nature of ¼ inch wide and 1/32 to 1/16 inch thick. For use by various parties, the graphite lead is available in various hardnesses.

While the carpenter's pencil is very desirable for use by carpenters and artists and the like, yet the problem remains as to how the pencil is to be sharpened. The most commonly used method of sharpening these pencils is to whittle away the wood and portions of the lead with a pen knife to form a rough point and then finishing up by applying a piece of sandpaper to the point. In fact, a two-stage sandpaper procedure may be used, a large grit sandpaper to firstly abraid the wood and the graphite lead and then finish with a fine sandpaper on the graphite lead and final elongated point of the pencil.

Now there have been pencil sharpeners devised for sharpening carpenter's type pencils, for example, Hamilton in U.S. Pat. No. 2,853,053 discloses such a device wherein a pair of oppositely opposed counter rotating cylindrical cutters receive the long side of the carpenter's pencil to place a point on it along the long edge of the rectangularly shaped pencil. However, no provision is made for chamfering the short sides of the rectangularly shaped carpenter's pencil to arrive at an elongated point.

In addition, Alpha, in two patents, namely U.S. Pat. Nos. 4,759,129 and 4,918,816 discloses pencil sharpeners adapted to sharpen a carpenter's pencil wherein four cutter heads are utilized to sharpen and chamfer the pencil, the four heads consisting of two pair of mutually opposed sharpening heads. By such means, all four sides of the carpenter's pencil are sharpened simultaneously. However, the devices of Alpha are indeed complicated mechanisms since all four cutter heads and their connecting gear, each mutually 90 degrees from each other, are engaged simultaneously by the prime mover resulting in a pencil sharpener costing a relatively large amount of money to construct because of the mechanical complexity of the device.

Other pencil sharpeners of the conventional type, i.e., that of placing a point upon a substantially round or octagonal shaped pencil, are shown in a number of patents, a couple of these being the 1915 Patent to Stewart, U.S. Pat. No. 1,160,091 and 1976 Patent to Aston, U.S. Pat. No. 3,965,949. Both of these pencil sharpeners utilize plantary type gears wherein a pair of pyramidal shaped rotary cutting heads each have a gear attached, the gear operating inside of a ring gear, the ring gear then turned by a hand crank.

Now Fortunati patented in 1901 a pencil sharpener, U.S. Pat. No. 673,770, alluded to above wherein the pencil is drawn across a single blade to remove wood shaving and then the lead is finally pointed with sandpaper or emery paper. The device of Fortunati catches the wood shaving and graphite particles as they are removed from the pencil. Lastly, Steinman in a 1920 patent, U.S. Pat. No. 1,333,740 illustrates a cutting machine for tailors' soap chalk wherein chalk may be machined on both sides simultaneously by two pair of oppositely opposed rotary cutters wherein the chalk is fed in at one end and taken out at the other. The chalk rests upon a carriage which carries it through the cutter machine.

It is readily apparent that devices are known which will sharpen carpenter's pencils, the devices ranging from very simple mechanism of placing a knife edge blade upon a flat surface to shave the wood of the pencil and providing sand paper for making a point to very complex mechanical devices which sharpen all four sides simultaneously.

However, it is also apparent that these devices have not been adapted by the public, perhaps because of the cost or inconvenience.

It is therefore readily apparent that there is need for apparatus which may be constructed relatively inexpensively, which is convenient to the user of the carpenter's pencil, and which is easily constructed. Such a device is provided by the instant invention.

SUMMARY OF THE INVENTION

The embodiment of the invention described consists of a carpenter's pencil sharpener having two openings as entrances to receive the rectangularly shaped pencil, one opening of which leads directly to a pair of rotary type cylindrical cutter heads adapted to cut the pencil away on opposite sides along its long sides to form the longitudinal point of the pencil. In addition, a second opening, at right angles to the first, receives the pencil to lead it to a second pair of oppositely opposed cutter heads designed to simultaneously chamfer opposite sides of the short sides of the carpenter's pencil. By such means, all four sides of the rectangularly shaped pencil are dressed.

Such is accomplished by a pair of stepped cylindrical shaped cutting heads, each of these stepped cutting heads having a centrally located shaft, both shafts parallel to each other. Each cylindrically shaped cutting head is spaced apart a fixed distance from its opposite counterpart so that an optimum point is placed upon the longitudinal length of the pencil graphite. A pair of oppositely spaced smaller cylindrically shaped cutting heads are also situated a fixed distance apart so that the ends of the short sides of the end of the carpenter's pencil is also appropriately chamfered.

Both shafts containing the stepped cylindrical cutting heads also have gears situated thereon, the gears engaging one another to assure that each cutting head rotates at the same speed, and one of the gears is powered by a third gear attached to the shaft of an electrical motor. Within the housing of the carpenter's pencil sharpener is provided space to contain a pair of batteries attached through a switch to the electrical motor driving the third gear.

Operation of the device is accomplished by the operator first energizing the electrical motor by means of the electrical switch which begins the rotation of the diagonally opposed pair of stepped cylindrical cutting rotor heads. The carpenter's pencil is first introduced into one of the two openings on the outside of the housing containing the invention to begin the cutting and shaving operation. The operator holds onto the pencil and pushes it downward, feeling the engagement of the cutting heads against opposite sides until he has determined that an appropriate point has been made along two of the opposite sides. The pencil is then withdrawn and inserted into the other opening, the other opening leading to a second pair of cylindrical opposed rotary cutting heads and the same procedure is followed by the operator, holding the pencil down until the operator determines that the chamfer of the pencil ends has been made. Of course sthe operator may withdrawn the pencil for a quick viewing and then reinsert the pencil as desired. Both the openings are so sized as to permit the entrace of the rectangularly shaped carpenter's pencil with very little clearance between the pencil and the sides.

Accordingly, it is an object of the subject invention to provide an inexpensively constructed carpenter's pencil sharpener which sharpens opposite sides of a rectangularly shaped carpenter's pencil to an elongated point.

It is another object of the subject invention to provide a carpenter's pencil sharpener wherein opposite sides of the carpenter's pencil are sharpened progressively in a two-step operation.

It is still another object of the subject invention to provide a carpenter's pencil sharpener employing a pair of stepped cylindrical rotary cutting heads, each upon a common shaft, which is easy to operate.

Other objects of the invention will in part be obvious and will in part appear hereinafter. The invention accordingly comprises the apparatus possessing the construction, combination of elements, and arrangement of parts which are exemplified in the following detailed disclosure and the scope of the application which will be indicated in the claims.

BRIEF DESCRIPTION OF THE DRAWINGS

For further understanding of the features and objects of the subject invention, reference should be had to the following detailed description taken in connection with the accompanying drawings wherein.

In various views, like index numbers refer to like elements.

DETAILED DESCRIPTION OF THE PREFERRED EMBODIMENT

Figure 1:
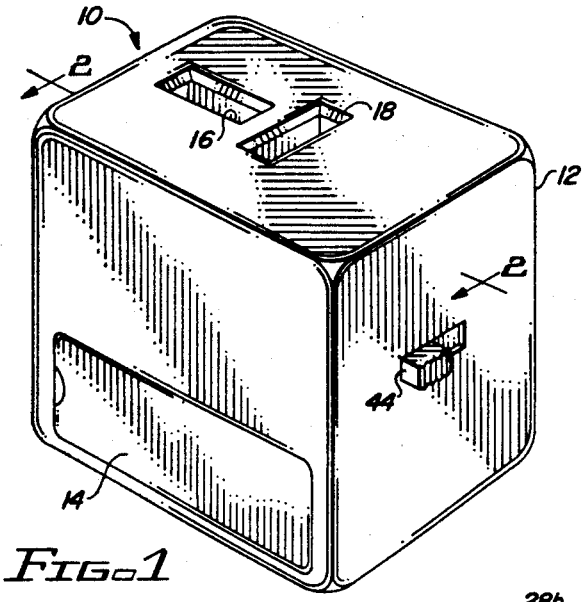
FIG. 1 is a perspective view of the subject inventive carpenter's pencil sharpener.

Referring now to FIG. 1, a perspective view is shown of the subject inventive carpenter's pencil sharpener 10 showing the two openings at the top adapted to separately receive the carpenter's pencil such that the pencil is appropriately sharpened on its two of its opposite sides and chamfered on the other. More particularly, sharpener 10 is shown in a generally rectangular shaped housing 12 which contains and mounts the pencil sharpening mechanism interiorly. Near the bottom of sharpener 10 is removable access door 14 which allows the insertion of batteries to operate the electrical motor contained inside sharpener 10 which in turn rotates the rotary blades. At the top of sharpener 10 are two mutually transverse openings for receiving the carpenter's pencil namely longitudinal opening 16 and opening 18 at right angles to opening 16.

the carpenter's pencil may be first inserted into longitudinal opening 16 which will allow the cylindrical cutters to carve away along the long sides (in cross-section) of the rectangularly shaped carpenter's pencil to form the elongated point. The pencil is then withdrawn and inserted into transverse opening 18 which chamfers the wood and graphite lead of the carpenter's pencil on the short sides (in cross-section). Carpenter's pencil sharpener 10 is so constructed that two different carpenter's pencils could be sharpened simultaneously, although, it is not anticipated that this will generally be the case.

Figure 2:
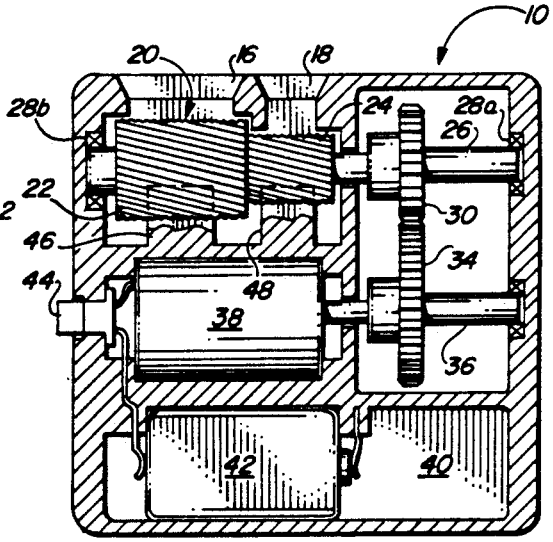
FIG. 2 is a cross-sectional view taken across sectional line 2—2 of the invention shown in FIG. 1.

FIG. 2 shows an interior cross-sectional view of the inventive carpenter's pencil sharpener 10 taken along sectional line 2—2 of FIG. 1. In FIG. 2, and starting from the top, the sides of longitudinal opening 16 and transverse opening 18 are shown leading down onto one of the pair of rotary cutting assemblies 20 consisting of two cylindrically shaped cutting heads having different diameters, the large diameter cylindrical cutting head 22 lying beneath and slightly to the side of the center of longitudinal opening 16 and the small diameter cylindrical cutting head 24 lying beneath and also off the center of transverse opening 18. Both these cylindrical cutting heads are mounted on a common shaft and share a common longitudinal center. The cylindrical cutting heads are situated upon the single shaft 26, which runs across the whole length of sharpener 10, which is journaled in bearings **28*a* and 28*b* mounted in the walls of housing 12. Also attached to shaft 26 is gear 30, gear 30 in turn being driven by drive gear 34. Drive gear 34 resides on motor shaft 36, shaft 36 comprising the rotor shaft of electrical motor 38. Shaft 36 may also be buried in bearings situated in the wall of housing 12** if desired.

Also shown in FIG. 2 is battery compartment 40, the compartment being immediately behind the removable access door 14 shown in FIG. 1. Located within is battery 42 electrically hooked up to switch 44 and electrical motor 38. Although switch 44 shown is manually operated, it is realized that it is well within the state of the art to employ electrical switches which activate upon the insert of the pencil into either of the openings 16 or 18. Lastly, the walls of housing 12 forming the sharpener are shown surrounding the interior parts of the sharpener including the strengthening bulkheads on either sides of the shafts 26 and 36 proximate the ends of small diameter cylindrical cutting head 24 and motor 38. Two pencil stops, 46 and 48, are shown which provide means to limit pencil travel into the cutting heads. Stop 46 limits travel when the lengthwise point is being cut by large cutting heads 22 and stop 48 limits travel when the short side of the pencil is being chamfered by small cutting heads 24. Both stops assure that the point is properly sharpened.

Figure 3:
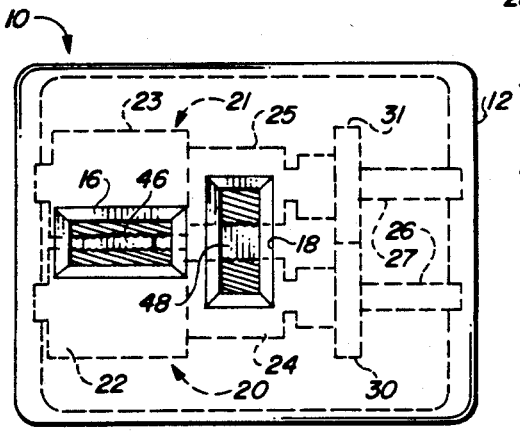
FIG. 3 is a top view of the subject invention.

FIG. 3 is a top view of the inventive carpenter's pencil sharpener 10 showing firstly the longitudinal opening 16 and the transverse opening 18, each of which receives the carpenter's pencil. Shown immediately inside the two rectangularly shaped openings are the pair of rotary cutting assemblies 20 and 21, rotary cutting assembly 20 previously shown in FIG. 2. More particularly, seen through longitudinal opening 16 are large diameter cylindrical cutting heads 22 and 23 on assemblies 20 and 21 respectively, spaced equally apart from the center of longitudinal opening 16 and set to have a specified distance between their outside cylindrical surfaces. Seen through transverse opening 18 are small diameter cylindrical cutting heads 24 and 25 stepped down, but on the same central shaft, as large diameter cylindrical cutting heads 22 and 23. That portion of each of the large and small diameter cylindrical cutters visible through the longitudinal and transverse openings are shown in solid relief whereas the portion not seen of each of these cylindrical cutters is shown in dotted relief. Obviously, the greater portion of each of these cylindrical cutting heads is not seen through the rectangularly shaped openings. Since by aligning the large diameter cylindrical cutting heads also aligns the small diameter cylindrical cutting heads, the relationship of the diameters of the cutting heads to each other must be related to the length and thickness of the pencil lead. At the very bottom of each of the rectangularly shaped openings are the stops 46 and 48, stop 46 situated between large cutting heads 22 and 23 and stop 46 between small cutting heads 24 and 25.

The pair of two-step rotary cutters are each aligned by means of placement of their central shafts, namely shafts 26 and 27 respectively, into their bearings. Attached to each of these shafts are gears 30 and 31 respectively. These gears are so designed as to mesh one with another so that as gear 30 is driven by gear 34 attached to the electrical motor (FIG. 2), gear 30 will drive gear 31. Both gears 30 and 31 are of the same diameter so that they run at the same speed.

Longitudinal opening 16 and transverse opening 18 are so designed in size as to be only slightly larger than the carpenter's rectangularly shaped pencil so that there is little opportunity for the pencil to slap from one side of the openings to the other as it is being sharpened. The distance each of the cylindrical cutting heads are from each other is carefully predetermined so as to give the requisite elongated sharpened point on the long sides of the carpenter's pencil and the chamfer on the short sides.

Figure 4:
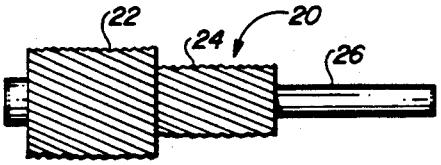
FIG. 4 is a side view of one of the two identical stepped cylindrical cutting heads.

Referring now to FIG. 4, a side view of one of the two substantially identical rotary cutter assemblies with stepped cylindrical cutting heads, here showing large diameter cylindrical cutting head 22 and small diameter cylindrical cutting head 24 juxtaposed to it, both mounted on shaft 26. The cylindrical cutting heads are of the type that have angled outwardly protruding cutting ridges which are sharpened to become the cutting blades, these ridges running at an acute angle to the longitudinal direction of shaft 26. As seen in FIG. 4, the rotary cutter assembly is stepped down from large diameter cylindrical cutting head 22 to small diameter cylindrical cutting head 24. Both these cutters may be made out of a single piece of hardened steel although it is obvious that they could be separate cutting heads juxtaposed each other on shaft 26. The cylindrical cutting heads are held onto shaft 26 by appropriate mechanical methods, such as use of an adhesive or by heat shrinking. Since the two rotary cutter assemblies run in opposite direction to each other, it is obvious that the cutting direction of the cutting blades on the large cylindrical cutting head on one rotary cutter assembly must be in the opposite direction to the cutting direction of the cutting blades of the large cylindrical cutting head on the other rotary cutter assembly. This is true on both the small diameter cutting heads also.

It is also obvious that the subject invention may operate with only one of the pair of stepped rotary cutter assemblies in place, rather than having opposed rotary cutter assemblies, inasmuch as each of the rectangularly shaped pencil openings secures the carpenter's pencil during the sharpening process by preventing side-to-side movement. A party, in operating the pencil sharpener with only one rotary cutter assembly, feels the cutting action of the pencil as it is held down. The same technique is used when both rotary cutter assemblies are in place.

Figure 5:
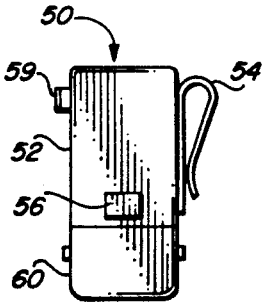
FIG. 5 is a side view of a portable alternate embodiment of the invention.

FIG. 5 is a side view of an alternate embodiment of the subject invention wherein the invention has been adapted for a person to wear it on their belt while they are on a job, such as a carpenter doing construction work. More specifically, alternate embodiment 50 consists of an outside housing 52 having at its top the two openings (not shown) which receive the carpenter's pencil for sharpening and on one side a clip 54 for the carpenter to hang the device on his belt. Shown centrally is one of the two charging electrodes 56 by which the chargeable battery interiorly to alternate embodiment 50 is charged. Near the top is electrical switch 58 by which the device is turned on and off by the operator. At the bottom of alternate embodiment 50 is removable portion 60, this removable portion allowing access to the batteries which power the electrical motor interiorly and also provides a sump to receive the filings and the wood shavings.

Figure 6:
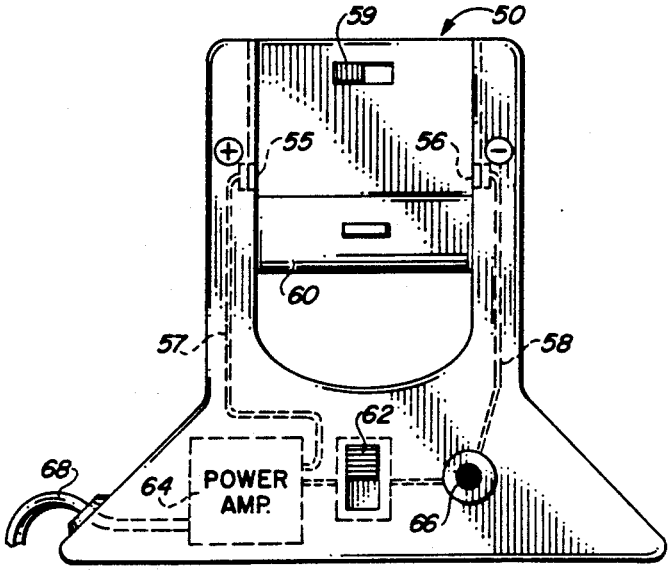
FIG. 6 is a front view of the alternate embodiment residing in a battery charger.

Lastly, FIG. 6 shows the charging device for charging the electrical batteries in alternate embodiment 50 shown in FIG. 5. In this view, the alternate embodiment is received into a cradle formed in the charger section wherein the to be charged electrodes 55 and 56 engage electrodes situated on opposite sides of the cradle. Attached to the electrodes in the cradle which meets electrodes 55 and 56 are electrical wires 57 and 58 (shown dotted), one of which is directed to an electrical rectifier 64, the other of which to light indicator 66. Charging switch 62 receives the second line emanating from rectifier 64 and diverts an output line to indicator 66. Charging indicator light 66 indicates when the alternate embodiment batteries are being charged. Rectifier 64 connects with electrical cord 68.

While a preferred embodiment of the invention has been shown and described, together with an alternate embodiment, it is appreciated that other such embodiments of the invention are possible and that there is no intent to limit the invention by such disclosure, but rather it is intended to cover all modifications and alternate embodiments falling within the spirit and the scope of the invention as defined in the appended claims.

I claim:

1. A pencil sharpener for sharpening rectangularly shaped carpenter's pencils comprising:

a housing;

a pair of rectangularly shaped openings situated in said housing, said rectangularly shaped openings juxtaposed each other and at right angles to each other;

a pair of rotary cutting assemblies interiorly to and operably attached to said housing, said pair of rotary cutting assemblies in an aligned relationship with said rectangularly shaped openings opening; and an electrical motor operably attached to said rotary cutting assemblies whereby a carpenter's pencil may be inserted into said openings and thereby engage said rotary cutting assemblies to be sharpened.

2. The carpenter's pencil sharpener as defined in claim 1 wherein each of said pair of said rotary cutting assemblies defines a large diameter cylindrical cutting head and a small diameter cylindrical cutting head juxtaposed to said large diameter cylindrical cutting head, both said large cutting head and said small cutting head mounted upon a central shaft, said shaft operably attached to said housing.

3. The carpenter's pencil sharpener as defined in claim 2 wherein each said central shaft of each of said pair of rotary cutting assemblies is situated parallel to each other and spaced apart that each said large diameter cylindrical cutting head on each shaft is juxtaposed each other and has a gap therebetween, and each said small diameter cylindrical cutting head on each shaft is also juxtaposed each other and has a gap therebetween, said small diameter cylindrical cutting head gap larger than said large diameter cylindrical cutting head gap.

4. The carpenter's pencil sharpener as defined in claim 3 wherein one of said pair of rectangularly shaped openings is operably aligned to each said large diameter cylindrical cutting head and the other of said pair of rectangularly shaped openings is operably aligned to each said small diameter cylindrical cutting head.

5. The carpenter's pencil sharpener as defined in claim 4 wherein said gap between each said large diameter cylindrical cutting head is centrally aligned with one of said pair of said rectangularly shaped openings, and said gap between each said small diameter cylindrical cutting head is centrally aligned with the other of said rectangularly shaped openings.

6. The carpenter's pencil sharpener as defined in claim 5 wherein each of said pair of rotary cutting assemblies includes a gear, each said gear mounted upon each said shaft of each of said pair of rotary cutting assemblies.

7. The carpenter's pencil sharpener as defined in claim 6 wherein each said gear attached to each said shaft engages each other.

8. The carpenter's pencil sharpener as defined in claim 7 wherein said electrical motor includes a gear attached thereto, said gear operably engaging one said gear attached to one said shaft of said pair of rotary cutting assemblies.

9. The carpenter's pencil sharpener as defined in claim 8 further including a pair of pencil stops operably attached to said housing, one of said stops operably situated between each said large diameter cylindrical cutting head, and the other of said stops operably situated between each said small diameter cylindrical cutting head.

10. The carpenter's pencil sharpener as defined in claim 9 further including a battery, said battery operably attached to said electrical motor.

11. The carpenter's pencil sharpener as defined in claim 10 further including means to recharge said battery, said means to recharge situated interiorly to said housing and operably attached to said battery.

* * * * *